US005140883A

United States Patent [19]

Fay

[11] Patent Number: 5,140,883

[45] Date of Patent: Aug. 25, 1992

[54] HARP ACTION

[76] Inventor: Douglas C. Fay, 7 Leverett Rd., Shutesbury, Mass. 01072

[21] Appl. No.: 649,743

[22] Filed: Feb. 1, 1991

[51] Int. Cl.[5] ..... G10D 1/04

[52] U.S. Cl. ..... 84/266

[58] Field of Search ..... 84/264, 265, 266

[56] References Cited

U.S. PATENT DOCUMENTS

| | | | |
|---|---|---|---|
| 1,332,885 | 3/1920 | Buckwell | 84/266 |
| 1,406,347 | 2/1922 | Clark | 84/266 |
| 3,739,680 | 6/1973 | Christiansen | 84/266 |

*Primary Examiner*—L. T. Hix

*Assistant Examiner*—Eddie C. Lee

*Attorney, Agent, or Firm*—Charles R. Fay

[57] ABSTRACT

In a harp complete with the usual strings, a device by which the tone of some or all of the strings may be provided with three tones, natural, flat, and sharp, the device including a manually manipulated disk having a partial arc-shaped barrel-like cam at its edge, which when rotated to a degree and impinging on a string, applies stress to the spring if desired, to change from one tone to another, and a pin or peg on the disk, parallel to the disk axis but offset, so that upon additional rotary motion, additional stress is imparted to the string, thereby attaining the third tone.

5 Claims, 5 Drawing Sheets

HARP ACTION

BACKGROUND OF THE INVENTION

Reference is made to Buckwell U.S. Pat. No. 1,332,885, Mar. 9, 1920, the present invention being an improvement of the harp action disclosed therein in which each string was given two tones by means of a hand-manipulated member that could be placed to shorten vibrating length and impart stress to a string or strings for one tone or release the stress for the natural tone thereof. This invention utilizes most of the patented harp action but obtains more tones for each string than the two tones of Buckwell, and with little or no extra hand manipulation.

SUMMARY OF THE DISCLOSURE

The present invention utilizes the same or similar general set-up: rockers, cranks, and disks rotarily occilated by the rockers and cranks and engaged with the separate strings (in multiple). Instead of using Buckwell's pins for this purpose, the present invention uses a cam and one pin for each disk, the cam engaging the string and thereby theoretically obtaining a range of tones by stressing the string from a zero point off the cam to a limit of stress. However, only the three tones, sharp, flat, and regular are wanted in reality and these are obtained by rotation of the disk-cam under influence of cranks moved manually by the rockers. Thus, the prior art obtains two tones, but by a relatively simple use of a cam, the present invention obtains three tones (or even more).

PREFERRED EMBODIMENT OF THE INVENTION

Figure 1:
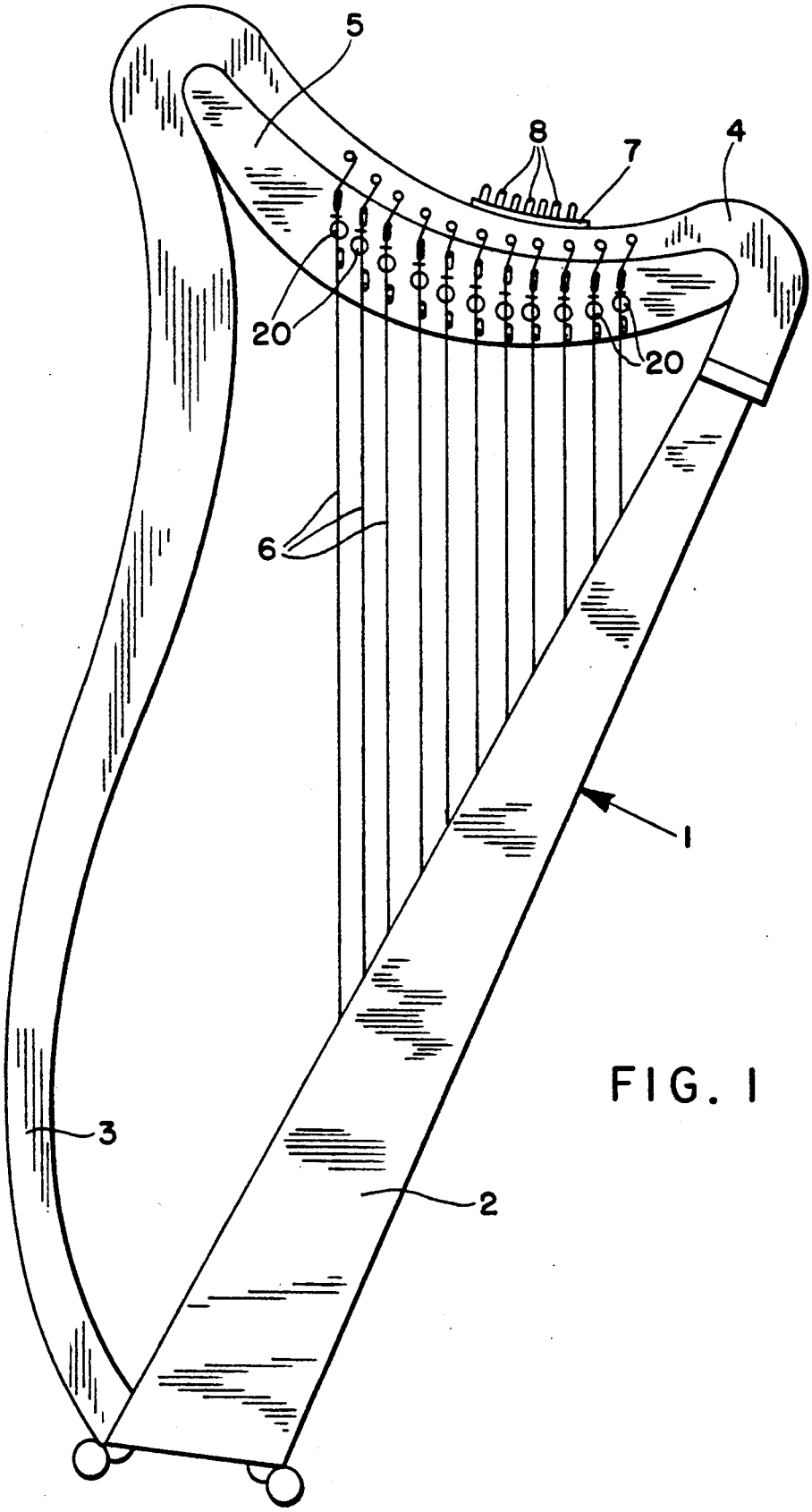
FIG. 1 is a side elevation of a harp embodying the invention.
Figure 2:
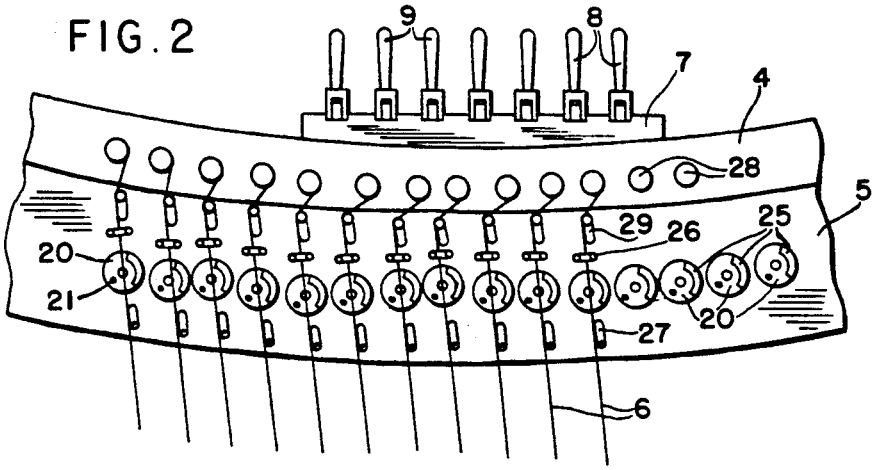
FIG. 2 is an enlarged side elevation of a portion of the neck of the same.

The improved harp 1 is provided with a body 2, a pillar 3, a neck 4, and combs 5 together with strings 6 which run from the neck 4 to the body 2 in the conventional manner. In the preferred embodyment of the invention 33 strings are employed by the harp with 31 of those strings being taken advantage of by the action.

Figure 4:
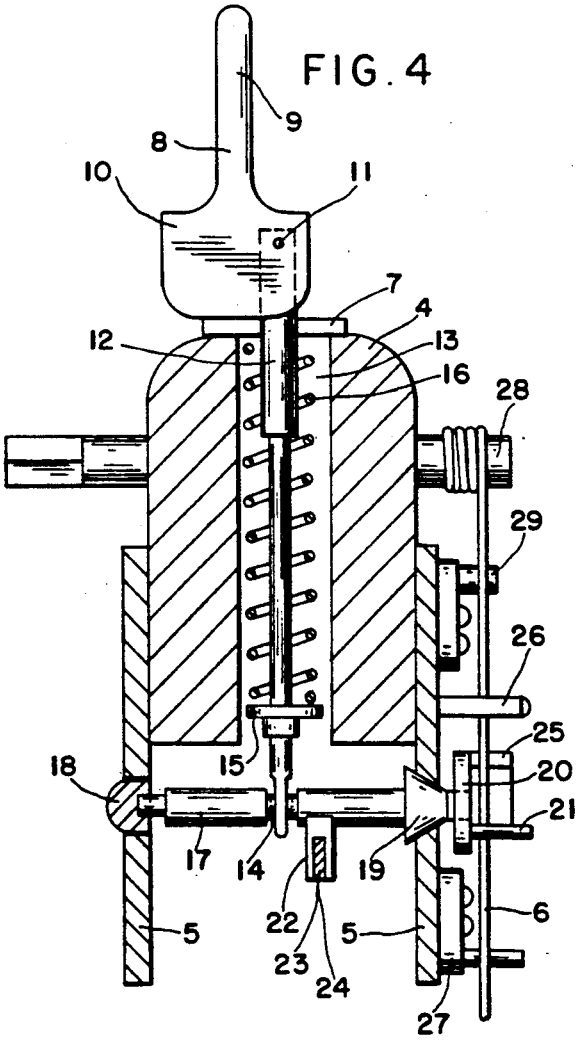
FIG. 4 is another sectional view taken substantially as indicated by the line 4—4 of FIG. 3 looking in the direction of the arrows.
Figure 3:
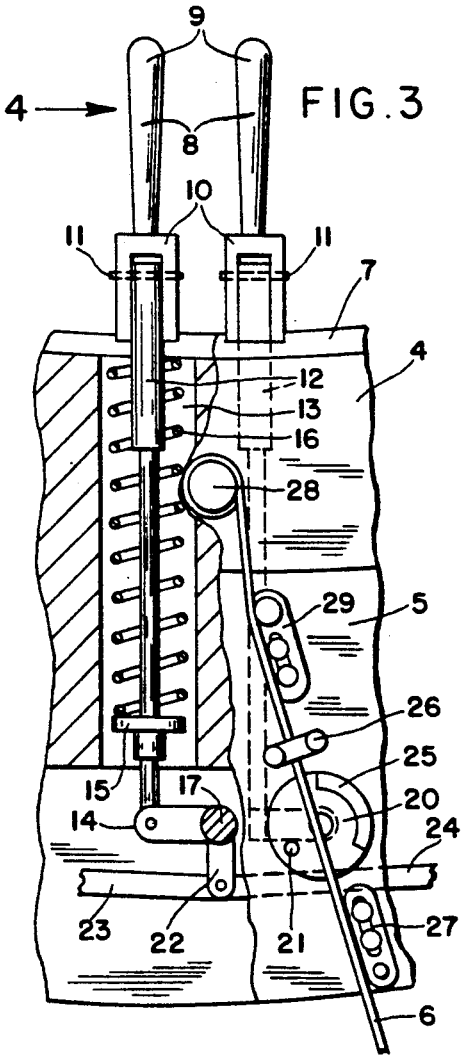
FIG. 3 is a sectional view showing a part of one action.

The top of neck 4 of the present harp is surmounted by a plate 7 on which are placed seven rockers 8, see FIGS. 3 and 4, (each rocker having three positions one each for the flat, natural and sharp note of its corresponding strings). Each of these rockers has an upright stem 9 and a laterally disposed base 10 which is slotted and provided with a corresponding opening in the plate 7 and extends downwardly through an opening 13 in the neck 4 to a crank 14 to which it is pivotally connected. This link 12 has a collar 15 fixed to thereon, and between this collar and the plate 7 and about the link 12 is mounted a coil spring 16 which normally keeps the rocker 8 upon the seat. The crank 14 is fixed to a shaft 17 which has one end journaled in a suitable screw cup 18 in a comb 5 and its other end has a conical bearing in the other comb 5 as shown at 19, and this end has fixed therein a cam-disk 20. When the rocker is shifted according to the desire of the musician playing the instrument, the link 12 is elevated against the tension of the spring 16, and then the shaft 17 is given an angular movement which is transmitted through the cam-disk 20 to the cam 25 and the finger 21 which are brought against the string 6 to bring the corresponding change in the note by the pressure of the cam against the string.

The novel feature of this invention resides in the rotational movement of cam-disk 20 acting on string 6 to shorten its vibrating length creating the desired pitch when sounded.

Figure 5:
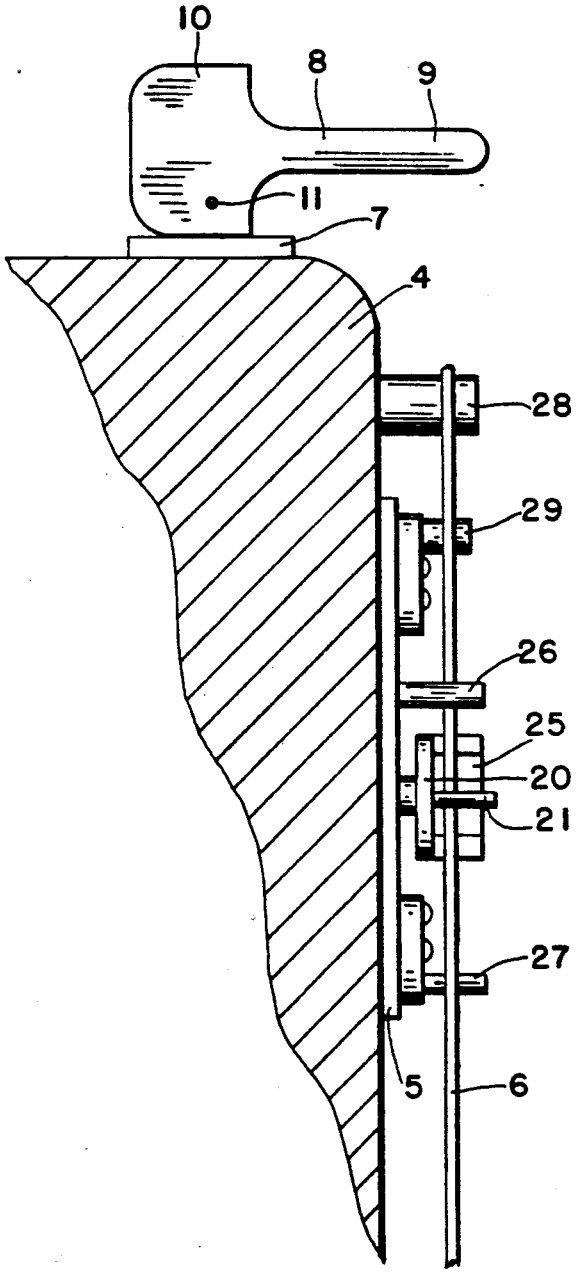
FIG. 5 is a representational section of one action in the flatted note position.
Figure 6:
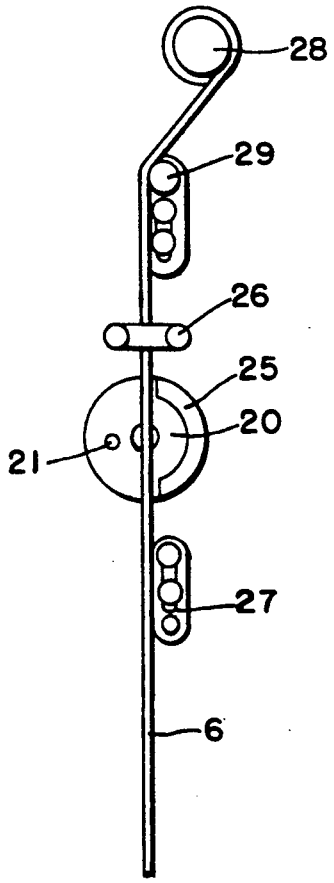
FIG. 6 is a diagrammatic view taken at right angles to FIG. 5.
Figure 7:
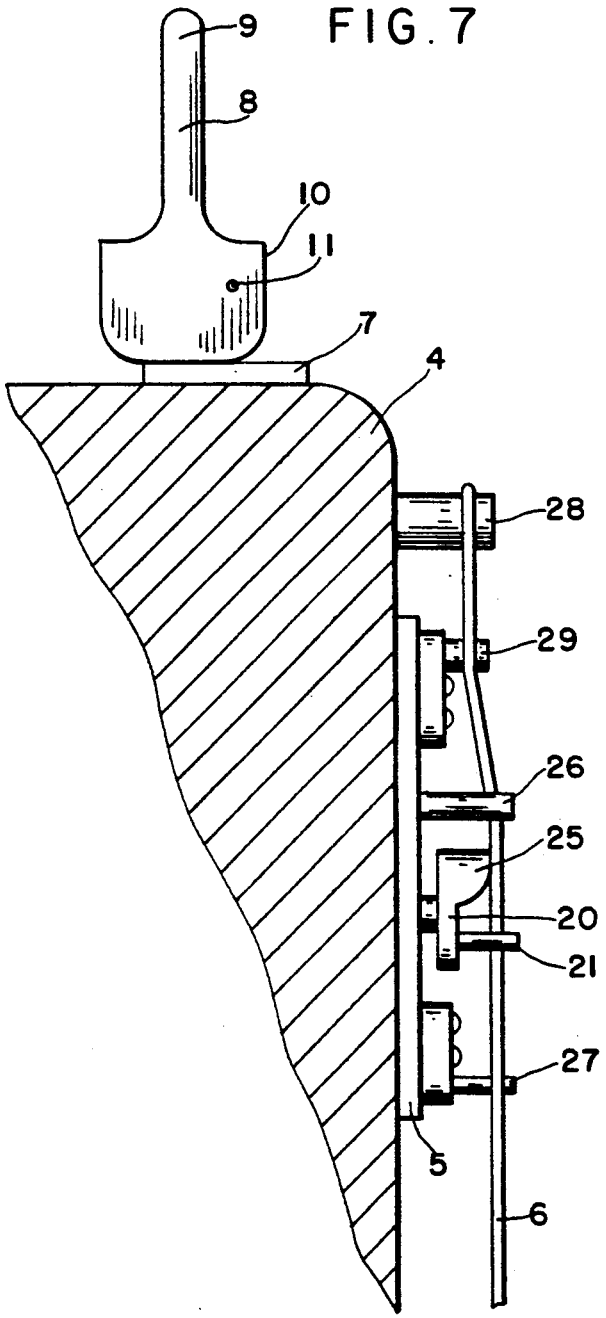
FIG. 7 is a representational section of the action in the natural note position.
Figure 8:
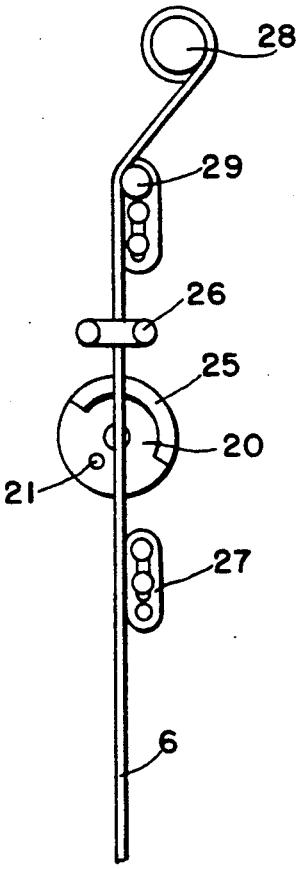
FIG. 8 is a diagrammatic view at right angles to FIG. 7.

The disk 20 which is provided with cam 25 is adapted to engage the string 6 by pushing it away from the comb 5 and against retainer 26 when at the desire of the musician playing the instrument the rocker 8 is moved from the flat position (FIG. 5) to the natural position (FIG. 7). Cam 25 can be made in such a way as not to alter the pitch beyond the desired amount even if the cam disk 20 rotates further than necessary.

The disk 20 is also provided with a pin or finger 21 which is adapted to engage the string 6 by pushing it toward the adjustable fret pin 27 until the string 6 and fret pin 27 touch each other and there is enough pressure to give a clear sound. This is caused to happen by moving rocker 8 form the natural position (FIG. 7) to the sharp position (FIG. 9) at the desire of the musician playing the instrument.

Adjusting the string 6 to sound at the correct pitch in the flat position (FIG. 5) is accomplished by angular adjustment of the tuning pin in the usual manner.

Adjusting the string 6 to sound at the correct pitch in the natural position (FIG. 7) is accomplished by adjusting nut pin 29.

Adjusting the string 6 to sound at the correct pitch in the sharp position (FIG. 9) is accomplished by adjusting fret pin 27.

In the foregoing has been described the action for a single string, and it will be understood that there are seven rockers for corresponding connections for seven strings so that the foregoing description provides for one octave. Provision is made for the corresponding strings of the other octaves in a manner which will now be described.

Each of the shafts 17, which has a crank 14 as above described, also has a vertical and laterally disposed crank 22 which is pivotally connected at its lower end to two links 23 and 24 which run to corresponding cranks 22 on corresponding shafts 17 which are precisely the same as described above, except they have no cranks 14.

From the foregoing it is apparent that when a rocker 8 is shifted, as above described all the shafts 17 for the corresponding note in different octaves are correspondingly shifted so that the same result is obtained as where an action referred to as "double action" is employed.

There has been shown and described one embodiment of the invention for it is obvious that it is not restricted thereto, but is broad enough to cover all structures that come within the scope of the annexed claims.

Figure 9:
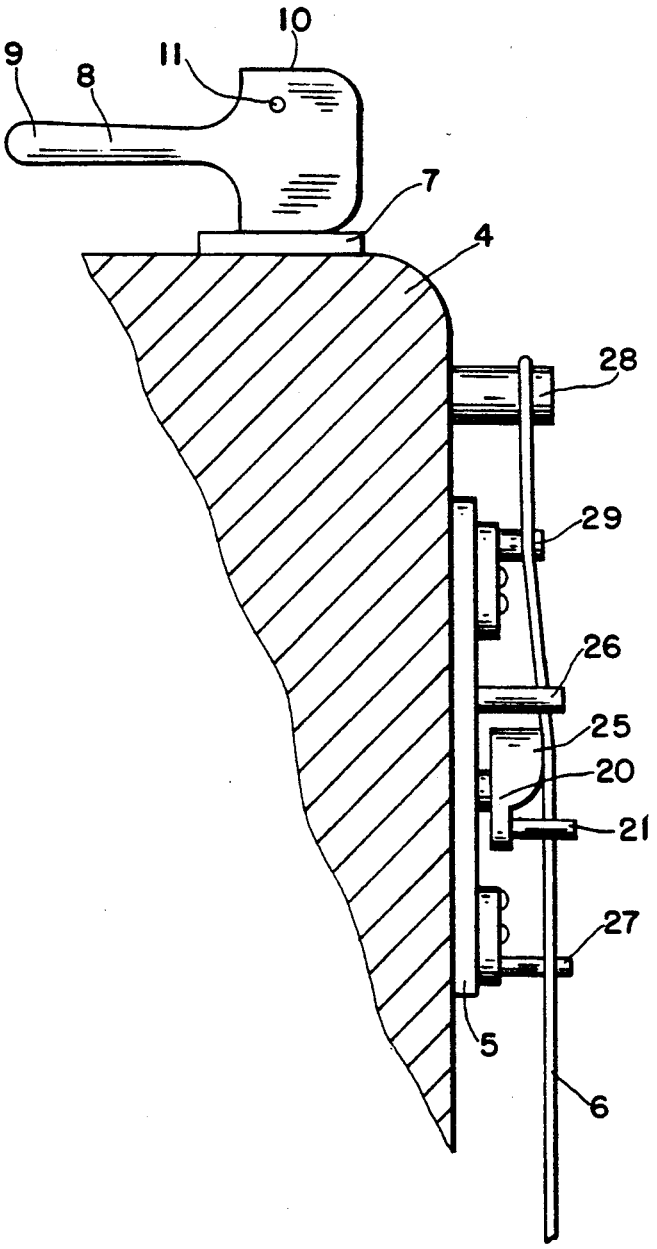
FIG. 9 is a representational section of an action in the sharped note position.
Figure 10:
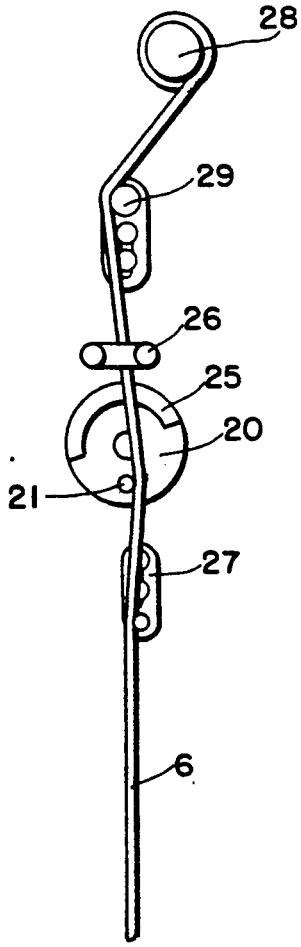
FIG. 10 is a diagrammatic view at right angles to FIG. 9.

Referring to FIGS. 5,6,7,8,9 and 10, FIG. 5 shows rocker stem 9 positioned to the right. This is the "flat" position leaving string 6 to vibrate from nut pin 29. FIG. 7 shows rocker stem 9 straight up in the "natural" position leaving string 6 to vibrate from the dwell of cam 25. FIG. 9 shows rocker stem 9 positioned to the left in the "sharp" position leaving string 6 to vibrate from fret pin 27. From these positions of operation it can be seen that now the apparatus provides the three tones.

I claim:

1. In a harp having a post, a neck, and strings, the improvement that comprises shiftable integral cam and pin means with an axis of rotation, string retainer means, adjustable fret pin means, adjustable nut pin means and rocker means to rotate said integral cam and pin means on its' axis engaging at least one string to be embraced at opposite sides of the string to shorten the vibrating length of a string when the string is plucked and increase tension to provide at least three tones for the string at different settings of said shiftable cam and pin means, the string being free of the cam and pin, retainer, and fret pin for one tone, the string being embraced by the cam and retainer for a second tone, the string being embraced by the integral pin and the fret pin for the third tone.

2. The harp of claim 1 wherein the cam is rotary and the pin is parallel to the cam axis, said axis being at right angles to the string.

3. The harp of claim 1 including manually operable means to rotate the cam and pin relative to the string, said manually operating means being connected to drive more than one cam simultaneously and equally.

4. The harp of claim 1 wherein the cam engages the string for natural.

5. The harp of claim 1 wherein both cam and pin impinge upon the strings for sharp.

* * * * *